United States Patent [19]

Verbrugge et al.

[11] Patent Number: 4,883,567

[45] Date of Patent: Nov. 28, 1989

[54] METHOD OF PLATING METALLO-GALLIUM FILMS

[75] Inventors: Mark W. Verbrugge, Troy; Michael K. Carpenter, Warren, both of Mich.

[73] Assignee: General Motors Corporation, Detroit, Mich.

[21] Appl. No.: 236,871

[22] Filed: Aug. 26, 1988

[51] Int. Cl.[4] ..... C25D 3/66

[52] U.S. Cl. ..... 204/39; 204/61; 204/64 R; 204/67; 204/71

[58] Field of Search ..... 204/39, 61, 64 R, 67, 204/71

[56] References Cited

PUBLICATIONS

Wicelinski et al, *Low Temperature Chlorogallate Molten Salt Systems,* JECS, 134 (1987) 262, published in Jan. 1987.

Wicelinski et al, *GaAs Film Formation from Low Temperature Chloroaluminate Melts,* Proc. 5th Int. Symp. on Molten Salts, vols. 86-1, the Electrochemical Society, 1986, p. 144.

*Primary Examiner*—John F. Niebling
*Assistant Examiner*—David G. Ryser
*Attorney, Agent, or Firm*—Lawrence B. Plant

[57] ABSTRACT

Electrocodeposition of uncontaminated metallo-gallium films (e.g., Ga-As) from a melt consisting essentially of $GaCl_3$-dialkylimidazolium chloride and a salt of the metal to be codeposited with the gallium wherein (1) the alkyl groups comprise no more than four carbons, (2) the molar ratio of the dialkylimidazolium chloride to the $GaCl_3$ is at least 1 but less than about 20, and (3) the molar ratio of the metal salt to the $GaCl_3$ is less than 0.5.

6 Claims, 4 Drawing Sheets

METHOD OF PLATING METALLO-GALLIUM FILMS

This invention relates to the electrocodeposition of metallo-gallium films from organochlorogallate melts.

BACKGROUND OF THE INVENTION

Metallo-gallium materials such as gallium-arsenic, gallium-antimony and gallium-arsenic-aluminum are known to have semiconductor properties The intermelallic gallium arsenide species (i.e., GaAs), for example, is particularly attractive as the electron transport therethrough is said to be five times greater than that of silicon and accordingly permits devices to be made therefrom which can operate at higher frequencies than comparable silicon devices, resulting in faster electronics. Moreover, GaAs has a direct band gap that: (1) makes it ideal for many opto-electronic applications such as semiconductor lasers and LED's; and (2) is near the optimum for solar energy conversion. For solar cell applications, GaAs is best utilized as a thin film spread over a large surface area. Electrodeposition would be an ideal way to make such a film.

No commercially practical method has as yet been devised to electrodeposit uncontaminated, equimolar metallo-gallium semiconductor films. In this regard, gallium-arsenic films have been electrocodeposited from: (1) aqueous solutions containing Ga and As ions; (2) $AlCl_3$-butylpyridinium chloride or $AlCl_3$-1-methyl-3-ethylimidazolium chloride melts (40° C.) containing arsenic and gallium chlorides; (3) potassium tetrachlorogallate melts (300° C.) containing arsenic triiodide; and (4) systems similar to the $NaPO_3$, NaF, and $Ga_2O_3$ fused salts (800° C.) used to deposit GaP. Such processes, however, leave much to be desired Aqueous solutions evolve hydrogen which competes/interferes with codeposition process. The $AlCl_3$-pyridinium-/imidazolium chloride methods are susceptible to aluminum contamination of the deposit and therefore precludes their practical use in making highly efficient Ga-As semiconductor devices. The potassium tetrachlorogallate and $NaPO_3/NaF/Ga_2O_3$ methods are practiced at temperatures which are unacceptably high in view of: (1) the volatility of arsenic and its salts; and (2) the nature of the materials required to construct thermally durable cells suitable for codepositing the gallium and arsenic. Finally, the lower temperature processes have relatively narrow ranges of operating parameters or ?windows" within which to successfully operate which accordingly makes them difficult to control on a commercially practical basis.

SUMMARY OF THE INVENTION

It is the principal object of the present invention to provide an improved, readily controllable method for reliably, electrolytically codepositing substantially uncontaminated, equimolar metallo-gallium semiconductor films over a relative broad range of operating parameters including ambient or near ambient temperatures. This and other objects and advantages of the invention will become more readily apparent from the detailed description thereof which follows and which is given hereafter in conjunction with the several Figures in which:

THE INVENTION

Figure 1:
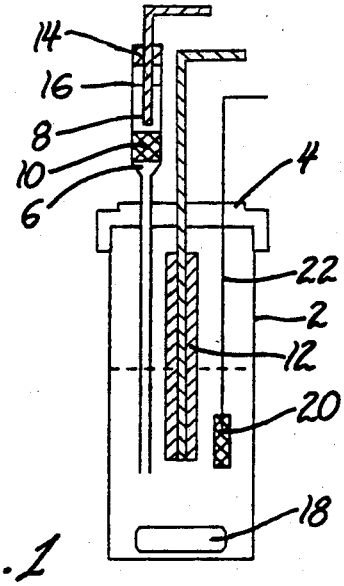
FIG. 1 schematically illustrates the cell used in making the present invention.

The invention comprehends a method for the electrocodeposition of a microcrystalline (i.e., crystallites less than about 1 micron in their narrowest dimension) film suitable for manufacturing semiconductor devices and having substantially equal atomic portions (hereafter equiatomic) of gallium and a metal selected from the group consisting of arsenic, antimony, and aluminum comprising the steps of: (1) immersing a conductive substrate opposite a gallium counterelectrode (preferably gallium) in an organochlorogallate melt comprising a salt of said metal and $GaCl_3$-dialkylimidazolium chloride wherein the alkyl groups comprise no more than four carbon atoms and the molar ratio of the dialkylimidazolium chloride to the $GaCl_3$ is at least 1 but less than about 20 and the molar ratio of the metal salt to the $GaCl_3$ is less than 0.5; and (2) cathodizing the substrate with respect to the counterelectrode at a potential established therebetween selected to codeposit the gallium and the metal onto the substrate at substantially equal rates.

1-methyl-3-ethylimidazolium-chloride (ImCl) is preferred among the available dialkylimidazolium chlorides because it can be used with consistent results over a broad range of operating parameters, (i.e., concentration, temperature, voltage and current) without deterioration and consequent contamination of the deposit. Tests have shown, for example, that ImCl can be used at room temperature and is resistant to oxidation and reduction over the potential range $-2.0$ to $+15$ volts. Other potentially useful dialkylimidazolium compounds include 1-methyl-3-methylimidazolium-chloride, 1-methyl-3-n-propylimidazolium-chloride, 1-methyl-n-butylimidazolium-chloride and 1-m-butyl-3-n-butylimidazolium-chloride.

The salt of the metal to be codeposited with the gallium is dissolved in the $GaCl_3$-dialkylimidazolium chloride melt and will preferably comprise a chloride for solubility, conductivity and melt compatibility reasons. Other potentially useful salts include bromides, sulfates, nitrates and phosphates of the metal(s) to be codeposited with the gallium. In the case where arsenic is to be codeposited with the gallium, the concentration of the $AsCl_3$ will not exceed 50% of the $GaCl_3$ and preferably be only about 5% to 10% that of the $GaCl_3$. In this regard, since As is the more noble component and deposits at potentials positive to that of Ga, small concentrations of $AsCl_3$ (relative to $GaCl_3$) should be employed to obtain equimolar deposits. Hence, on a molar basis, the ratio of the $AsCl_3$ concentration to the $GaCl_3$ concentration will be less than 0.5 and preferably about 0.05 to about 0.1. When the $AsCl_3/GaCl_{13}$ ratio exceeds 0.5, arsenic deposition predominates and too little gallium is deposited. In the $AsCl_3/GaCl_3$ range of 0.05 to 0.10, equimolar Ga-As deposits are readily attainable at voltages which do not require excess energy consumption. When aluminum is also to be deposited along with the gallium and arsenic, $AlCl_3$ is added to the melt in suitable proportions A preferred melt for gallium-arsenic codeposition is made by mixing solid $GaCl_{13}$ with solid 1-methyl-3-ethylimidazolium chloride. The reaction is believed to proceed as follows:

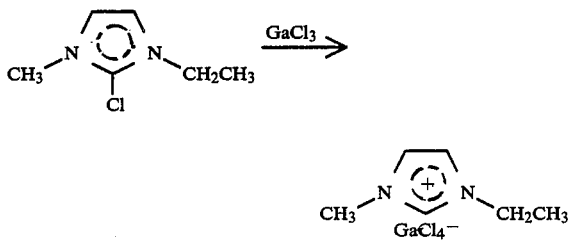

The electrolytic deposition of gallium metal results from the reduction of gallium chloride species as follows:

$$GaCl_4^- + 3e^- \rightleftarrows Ga + 4Cl^-$$

Addition of $AsCl_3$ to the $GaCl_3$—ImCl melt is believed to yield arsenic anions and more $Im^+$as follows:

$$ImCl + AsCl_3 \rightleftarrows Im^+ + AsCl_4^-$$

Arsenic electrolytic deposition results from reduction of the arsenic chloride species which occurs at potentials positive to that required for gallium deposition. By controlling the deposition potential and the arsenic and gallium ion concentrations, the gallium and arsenic can be made to deposit at substantially the same rate so as to yield a microcrystalline material having substantially equal amounts of gallium and arsenic in the form of a composite of GaAs in a gallium-arsenic phase. Gallium arsenide (GaAs) comprised about 25% of our as-deposited films. The gallium-arsenic phase is believed to be a solid solution which has independent semiconductor properties less optimal than that of GaAs, and which is thermally convertible to GaAs if optimal semiconductor properties are sought.

Tests (i.e., using an $ImCl/GaCl_3$ ratio of 1.5) indicate that deposition within a preferred potential range between about 0 and about -1 volts (i.e., as measured between an aluminum reference electrode and the cathode) will codeposit equal amounts of Ga and As regardless of the $AsCl_3$ content of the melt (i.e., below the 0.5 $AsCl_3/GaCl_3$ limit). The precise voltage within that potential range for any given melt will of course vary with the gallium chloride and arsenic chloride content and to some extent temperature. Since As is the more noble component and deposits at potentials positive to that of Ga, relatively small concentrations of $AsCl_3$ (relative to $GaCl_3$) should be employed to obtain equiatomic deposits. We prefer $AsCl_3/GaCl_3$ ratios of about 0.05 to about 0.10. By way of illustration, it was determined that at an arsenic chloride concentration of about 4% by weight in a GaCl-ImCl melt containing 45% by weight $GaCl_3$, the potential required to achieve substantially equal Ga and As deposition rates is about −0.8 volts. The more $AsCl_3$ present in the melt the more negative the potential must be to obtain the desired equal amounts of As and Ga in the deposit. Too negative a potential is undesirable because it: (1) increases the risk of breaking down the organic electrolyte; and (2) requires more energy and hence a less cost effective process Our tests showed that the smaller cathodic potentials yield deposits of larger arsenic mole fraction. At more negative potentials, it is probable that the arsenic deposition reaction is transport limited by the low concentration of the arsenic species in the bulk electrolyte relative to the $GaCl_3$ concentration. For potentials negative of approximately −1.0 volt, the steady-state Ga-deposition and Ga-As codeposition processes are more complicated and the deposition of Ga is hindered, possibly because of $Im^+$adsorption.

Importantly, we have concluded that only those $GaCl_{13}$-dialkylimidazolium chloride compositions which fall within the so-called ?basic" range will consistently yield acceptable results over a sufficiently broad range of operating parameters to make the process commercially practical and controllable. ?Basic" compositions are defined as those wherein the molar ratio of the dialkylimidazolium chloride content of the melt to the $GaCl_3$ content of the melt is greater than 1. $ImCl/GaCl_3$ ratios between 1 and 20 are considered useful for the present invention. When this ratio is below 1 (i.e., an "acidic" melt), the chemistry of the system is quite complex giving rise to the formation of such detrimental gallium species as $Ga_2Cl_7^-$ which may be reduced at a significantly different potential than the $AsCl_4^-$ which in turn makes equiatomic codeposition difficult if not impossible. On the other hand, the "basic" system: (1) insures that only the $GaCl_4^-$ gallium species is present, the reduction potential of which is almost indistinguishable from that of $AsCl_4^-$; and (2) permits the arsenic chloride concentration to be much closer to that of the gallium chloride concentration; both of which makes it easier to codeposit the Ga and As at essentially the same rate. When the ratio of the dialkylimidazolium chloride to the $GaCl_3$ exceeds about 20, the high organic content results in a highly resistive, viscous melt which: (1) is susceptible to electrolytic breakdown and contamination of the deposit; and (2) requires uneconomically high negative potentials to drive equiatomic Ga and As deposition. Finally, as the melt becomes more ?basic" and the $AsCl_3$ content remains the same, the ratio of the $AsCl_3/GaCl_3$ increases and more negative potentials are needed to codeposit the Ga and As. Melts having an $lmCl/GaCl_3$ ratio of about 1.5 are effective and practical.

The melt of the present invention has the advantage of being usable at room temperature which is important if volatilization of the $AsCl_3$ is a concern. Elevated temperatures, however, result in a more conductive melt which not only results in larger crystallites but does not require as much energy to achieve equiatomic Ga-As deposits.

Experimental

Tests were conducted in a cell shown schematically in FIG. 1. The cell comprised a sealed, glass vial 2 having a polytetrafluoroethyene (PTFE) septum 4 sealing off the top of the vial 2. A glass capillary pipette 6 pierced the septum 4 and served as a compartment for an aluminum reference-electrode 8. Glass wool 10 packed into the lower portion of the compartment impeded electrolyte transfer from the pipette compartment into the vial 2 containing the cathode 12. 40:60::$GaCl_3$:ImCl electrolyte melt (i.e., ImCl-/$GaCl_3$=1.5) was drawn into the reference-electrode compartment from the vial 2 by means of a syringe having a needle that passed through a gas-tight septum 14 at the top of the pipette 6. The suction created pulled melt from the vial 2 (i.e., before $AsCl_3$ was added) into the reference compartment to a level 16 which did not change during the experiments. The cathode 12 comprised 0.08-$cm^2$ glassy-carbon disks having an inert chlorofluorocarbon polymer (Kel-F) enshrouding all but an exposed carbon surface. The counterelectrode 20 comprised molten gallium in a small glass crucible contacted by a platinum wire 22. The platinum wire 22 was sealed in the bottom of the glass crucible, and provided electrical contact to the potentiostat. A magnetically rotatable Teflon coated bar 18 in the bottom of the vial 2 provided stirring of the melt. The potential between the cathode 12 and reference electrode 8 as well as the power required to pass current between the cathode 12 and the gallium counterelectrode 20 was provided by a combination potentiostat and galvanostat. An aluminum wire (1.5-mm diameter) was used as the reference electrode 8 and all potentials reported herein are that of the cathode 12 relative to the Al reference electrode 8.

1-methyl-3-ethylimidazolium chloride was prepared by reacting ethylene chloride with 1-methylimidazole. The resulting crystals were dissolved in reagent-grade acetonitrile and precipitated in a large excess of reagent-grade ethyl acetate. After vacuum drying the ImCl powder was placed in a sealed vial. Various $GaCl_3$-ImCl melts ranging from 0.1 to 9 molar ratio of ImCl to $GaCl_3$ were made by adding solid $GaCl_3$ to the ImCl powder. An exothermic reaction between the solids yielded a clear melt which was allowed to cool and equilibrate for at least 10 hours before use. $AsCl_3$ was then added to the $GaCl_3$-ImCl melt.

All experiments were conducted in a glove box containing a dry-nitrogen environment and having its escape-gas valve vented to a hood owing to the volatility and toxicity of $AsCl_3$. Following gallium-arsenic deposition, the deposits were characterized by (1) scanning electron micrography; (2) energy dispersive analysis (EDS) for elemental composition; and (3) X-ray photoelectron spectroscopy (XPS). Comparison of the XPS and EDS analyses indicates that the deposit is not homogenous in composition but rather comprises about 25% GaAs intermetallic and the remainder elemental gallium and arsenic.

SPECIFIC EXAMPLE

Electrodeposition was conducted in the aforesaid cell containing about 13 grams of a $GaCl_3$-ImCl melt comprising 45 weight percent $GaCl_3$ to which 0.6 grams $AsCl_3$ was added to provide a melt having about 4.4 percent $AsCl_3$ concentration.

Electrodeposition at various potentials between 0 and −2 volts (i.e., relative to the Al reference electrode) gave codeposits of Ga and As. Substantially equiatomic Ga-As deposits were obtained in the range −0.4 to −1.0 volts. It is expected that lower $AsCl_3$ concentrations will permit equiatomic deposits to be obtained at about 0 volts. The formation of GaAs was confirmed by x-ray photoelectron spectroscopy and scanning electron micrographs indicated that the deposits contained spherical growths approximately 3 μm in diameter.

Figure 2:
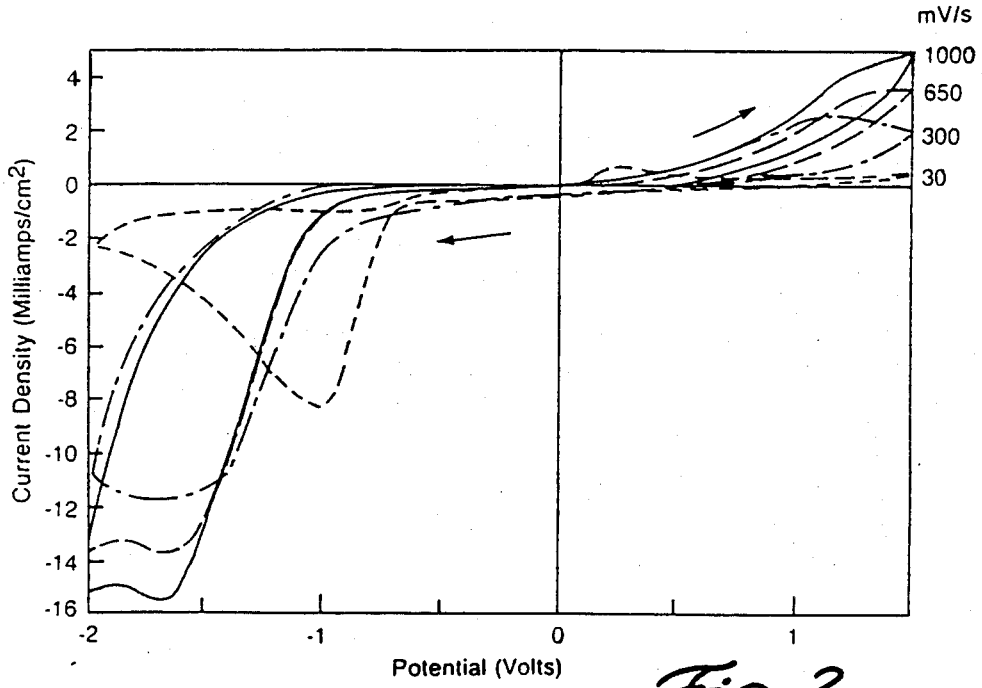
FIG. 2 are cyclic voltammograms at different sweep rates of one electrolyte in accordance with the present invention.

In other tests, the same $GaCl_3$-ImCl melt described above had 150 μL of $AsCl_3$ added to it and was studied by cyclic voltametry techniques. FIG. 2 shows the cyclic voltammograms of the uniform and sustained periodic state for the $AsCl_3$—$GaCl_3$-ImCl electrolyte at various linear scan rates between 30 mV/s to 1000 mV/s. The shape of the voltammograms in FIG. 2 are similar to the shape of the voltammograms for $AsCl_3$-free $GaCl_3$-ImCl but the magnitude of the cathodic current densities (i.e., lower left quadrant) were reduced significantly for the $AsCl_3$-rich melt. The peak cathodic current densities for the 300, 650 and 1000 mV/s scan rates increased with increasing sweep rates which is indicative of a diffusion controlled deposition process. It is not clear why the half-wave potential for the deposition process is shifted to such positive values (i.e., ca. −0.7V) for the 30 mV/s scan rate.

Figure 4:
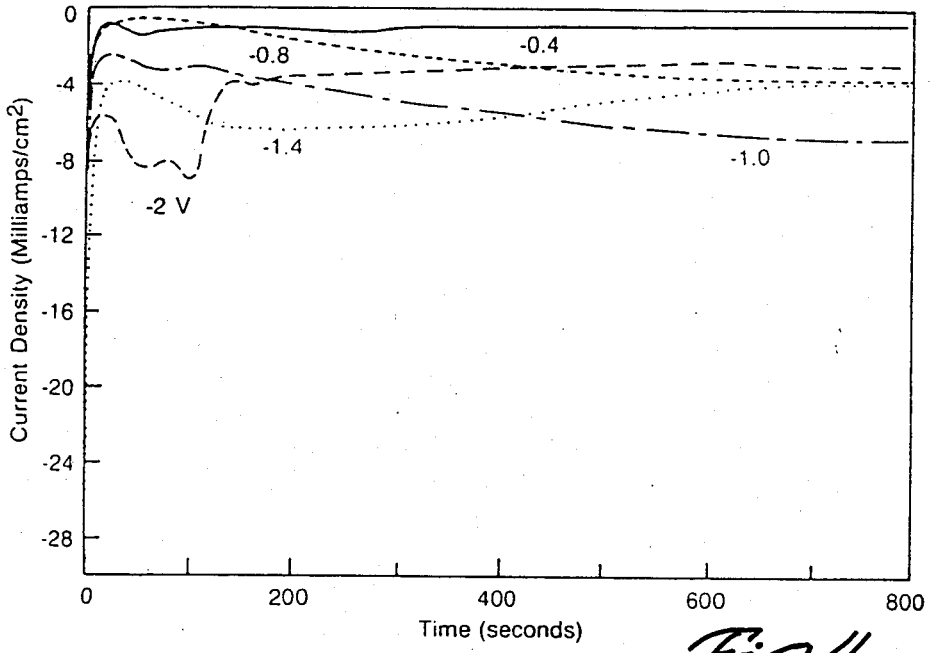
FIG. 4 are potential-step curves for an electrolyte in accordance with the present invention.

The effect of increased $AsCl_3$ concentration is shown in FIG. 4 which is a cyclic voltammogram (i.e., at 1000 mV/s) of the uniform and sustained periodic state for two different $AsCl_{13}$ concentrations (i.e., 150μL and 300 μL/13 g of $GaCl_3$-$ImCl_3$). The half-wave potential for the deposition process is shifted to more positive potentials and higher peak current densities are obtained for the 300-μL $AsCl_3$ case relative to the 150-μL case. The shift in the half-wave potential is consistent with the standard electrode potential for the As deposition process being positive to that of the Ga deposition process. Moreover, the higher $AsCl_3$ content (i.e., 300μL) resulted in higher cathodic currents than for the 150 μL concentration. Hence, the anodic reaction appears to be hindered by the increased $AsCl_3$ concentration.

Figure 3:
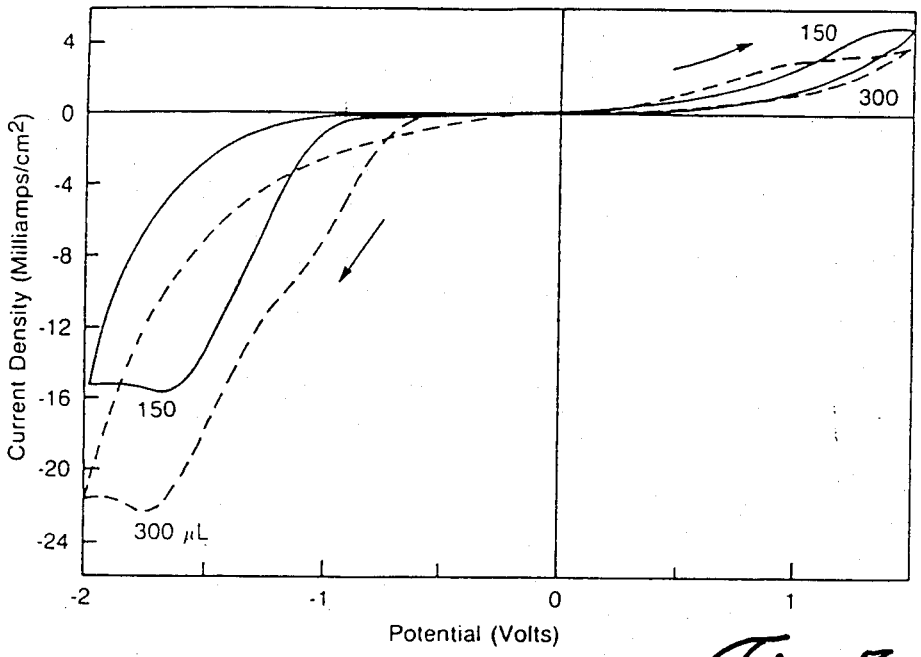
FIG. 3 are cyclic voltammograms (i.e., 1000 mV/s sweep) of two electrolytes in accordance with the present invention.

Analysis of FIGS. 2 and 3 indicates that deposition within the potential region between 0 and −2 volts should yield codeposits of Ga and As. Results of potential-step experiments within this potential region are shown in FIG. 4. For all the potential-step experiments, a steady state was reached after about 800 seconds. The results of FIG. 4 can be related directly to those of the 30-mV/s data shown in FIG. 2. The current densities from the 30-mV/s and potential-step experiments are given in Table 1 along with their corresponding potentials.

TABLE 1

Current densities and deposit compositions.

| Potential (volts) | Cathodic Current Density ($mA/cm^2$) 30 mV/s | Cathodic Current Density ($mA/cm^2$) Potential Step | Deposit Composition Potential Step (mole fraction As) |
|---|---|---|---|
| −0.4 | 0.9 | 0.8 | 0.80 |
| −0.8 | 4.3 | 4.0 | 0.68 |
| −1.0 | 8.0 | 6.6 | 0.13 |
| −1.4 | 6.9 | 4.0 | 0.38 |
| −2.0 | 2.1 | 1.0 | 0.16 |

The deposit compositions, measured by EDS, are also listed for the potential-step experiments. The cathodic current densities are slightly lower for the step experiments, relative to those of the 30-mV/s experiments. This is to be expected as larger instantaneous current densities are obtained for sweep experiments relative to steady-state experiments. The smaller cathodic potentials yield deposits of larger arsenic mole fraction, as is indicated in Table 1.

Figure 5:
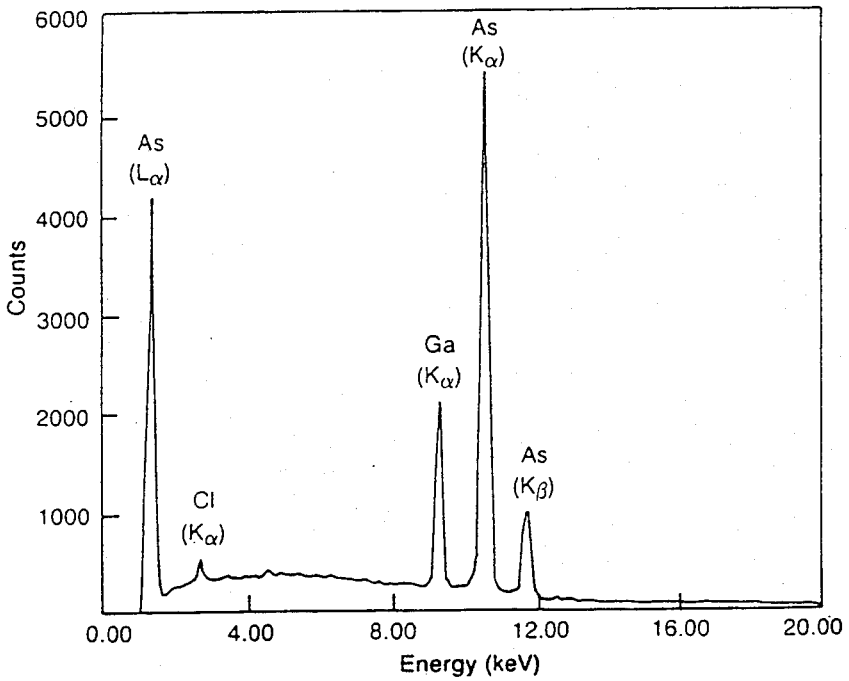
FIG. 5 shows the energy-dispersive-spectroscopy results of a gallium-arsenic deposit formed in accordance with the present invention.

The EDS spectrum used to ascertain the deposit composition for the −0.4-volt potential-step experiment is shown in FIG. 5. Enlargements of the EDS spectrum around various energies showed clearly some of the As and Ga lines corresponding to lower x-ray counts that are not visible in FIG. 5 because of the scale. Small amounts of chlorine were also detected. A scanning electron micrograph of the −0.4-volt deposit revealed that the deposit morphology consists of spherical nodules of about 3-μm diameter.

X-ray photoelectron spectroscopy (XPS) was used to gain information concerning the chemical state of the deposit. Samples deposited at −0.4, −0.8 and −2.0 volts and analyzed with XPS all showed the presence of As, Ga, Cl, O and C. The latter two elements were not found by EDS due to the inability of the instrument used to detect elements with atomic numbers less than 11. The carbon content of the samples was found to be greater than 40%, which was probably due to uncovered portions of the glassy-carbon substrate. Semi-quantitative XPS analysis of the −0.4-volt deposit yielded a Ga:As atomic ratio greater than 2.5. In contrast EDS results indicated the ratio to be 0.2. The different results from the different analytical techniques suggests that the deposit was not homogeneous in composition throughout its thickness. In this regard, EDS probes more deeply (i.e., about 1–2 microns) than XPS (i.e., less than 50 A).

Figure 6:
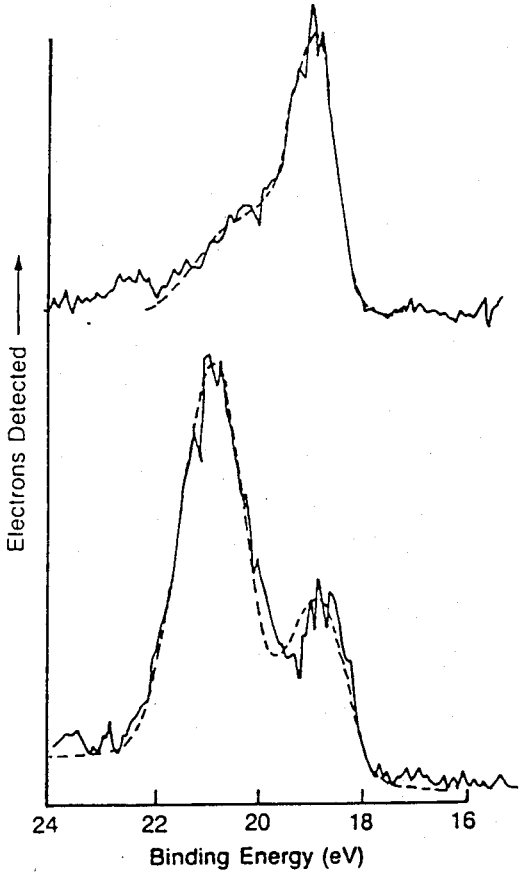
FIG. 6 shows the results of X-ray photoelectron spectroscopic analysis of a gallium-arsenic deposit formed in accordance with the present invention.
Figure 7:
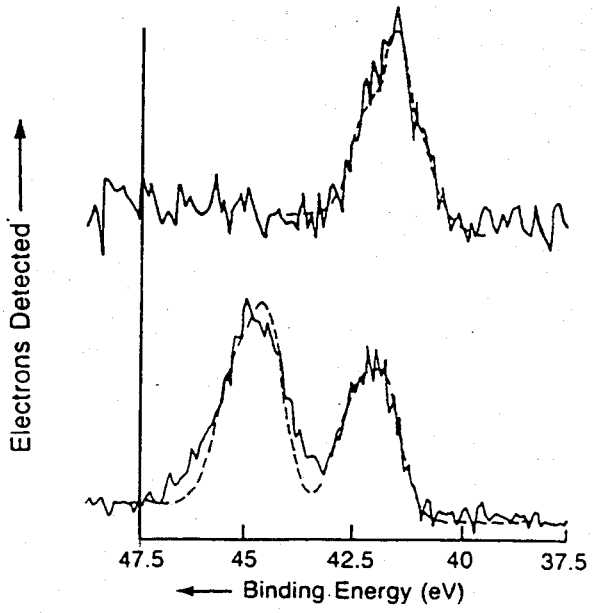
FIG. 7 shows the results of X-ray photoelectron spectroscopic analysis of a gallium-arsenic deposit formed in accordance with the present invention.

High resolution XPS spectra from the samples deposited at −0.4 volts are shown in FIGS. 6 and 7. The lower panels of each FIGS. 6 and 7 correspond to the XPS spectrum from the sample as deposited, whereas the upper panels show spectra from the same sample after about 300 A were removed from the surface by argon-ion sputtering. The spectra show binding-energy peaks due to gallium species at 16–24 eV (FIG. 6) while peaks assigned to arsenic species appear in the range of 37–47 eV (FIG. 7). For the unsputtered deposit, the two peaks due to gallium species were attributed to gallium metal and gallium oxide on the basis of comparison with published data and curve-fitting analysis. Each peak was modeled as the sum of two peaks due to the spin-orbit coupling of the gallium. Similarly, the arsenic peaks of the unsputtered deposit are consistent with the presence of arsenic and arsenic oxide. The unsputtered sample showed no evidence of gallium arsenide on the surface. However, upon removal of the surface layer of the deposit by argon ion sputtering, the XPS spectrum changed significantly. Elemental analysis, from survey spectrum data (not shown), indicates that oxygen and chlorine were essentially surface impurities, and the relative increase found in carbon content was caused by the exposure of more of the carbon substrate. The high-resolution spectra of the sputtered sample, shown in the top panels of FIGS. 6 and 7, can no longer be attributed only to gallium, arsenic, and their oxides. While about 75% of the deposited material does consist of elemental gallium and arsenic, the spectral envelopes obtained are most effectively modeled by the inclusion of peaks consistent with the presence of the intermetallic, gallium arsenide.

While the invention has been disclosed primarily in terms of specific embodiments thereof it is not intended to be limited thereto but rather only to the extent set forth hereafter in the claims which follow.

The embodiments of the invention in which an exclusive property or privilege is claimed are defined as follows:

1. A method for the electrocodeposition of a substantially uncontaminated microcrystalline film having substantially equal atomic portions of gallium and a metal selected from the group consisting of arsenic, aluminum and antimony comprising the steps of:

immersing a conductive substrate opposite a counterelectrode in an organochlorogallate melt consisting essentially of a salt of said metal and a $GaCl_3$-dialkylimidazolium chloride wherein (1) the alkyl groups comprise no more than four carbons, (2) the molar ratio of the dialkylimidazolium chloride to the $GaCl_3$ is at least 1 but less than about 20, and (3) the molar ratio of the metal salt to the $GaCl_3$ is less than 0.5;

and cathodizing said substrate at a potential selected to codeposit said gallium and metal at substantially equal rates onto said substrate.

2. A method according to claim 1 wherein said metal comprises arsenic and said dialkylimidazolium comprises 1-methyl-3-ethylimidazolium.

3. A method according to claim 2 wherein the $As^{+3}/Ga^{+3}$ is between about 0.05 and about 0.1.

4. A method according to claim 2 wherein said cathodizing is performed at substantially room temperature.

5. A method according to claim 1 wherein the molar ratio of the dialkylimidazolium chloride to the $GaCl_3$ is about 1.5 and said potential is between about 0 and −1 volts measured relative to an aluminum reference electrode coupled to said substrate.

6. A method according to claim 1 wherein said counterelectrode comprises gallium.

* * * * *